US006981884B2

(12) United States Patent
Deng

(10) Patent No.: US 6,981,884 B2
(45) Date of Patent: Jan. 3, 2006

(54) CONTACT FOR SOCKET

(76) Inventor: Limin Deng, P.O. Box 26-757, Taipei 106 (TW)

( * ) Notice: Subject to any disclaimer, the term of this patent is extended or adjusted under 35 U.S.C. 154(b) by 29 days.

(21) Appl. No.: 10/861,606

(22) Filed: Jun. 4, 2004

(65) Prior Publication Data

US 2004/0248440 A1 Dec. 9, 2004

(30) Foreign Application Priority Data

Jun. 4, 2003 (CN) ..... 03246906

(51) Int. Cl.
*H01R 12/00* (2006.01)

(52) U.S. Cl. ..... 439/83; 439/876

(58) Field of Classification Search ..... 439/83, 439/876, 82, 81, 84, 70, 326
See application file for complete search history.

(56) References Cited

U.S. PATENT DOCUMENTS 4,978,307 A * 12/1990 Billman et al. ..... 439/83
5,057,027 A * 10/1991 Yamada et al. ..... 439/83
5,551,883 A * 9/1996 Davis ..... 439/65
6,132,222 A * 10/2000 Wang et al. ..... 439/70
6,210,176 B1 * 4/2001 Hsiao ..... 439/71
6,295,726 B1 * 10/2001 Maatta ..... 29/827
6,501,665 B1 * 12/2002 Ted ..... 361/808
6,755,667 B2 * 6/2004 Lin ..... 439/83

* cited by examiner

*Primary Examiner*—Hien Vu
(74) *Attorney, Agent, or Firm*—Apex Juris, pllc; Tracy M Heims

(57) ABSTRACT

A contact adopted for a socket includes a base, an orientation arm, a resilient arm, and a solder portion. The resilient arm has a first portion extending from the base and a second portion upwards bent from the first portion, and the second portion of the resilient arm parallels to the base as an inverse type with a straight, turning angle. Therefore, the contact is processed easily and simply and further capable of a secure connection to a peripheral device, and a contact resistance between the contact and the peripheral device is reduced thereby to guarantee an effective electrical contact.

5 Claims, 5 Drawing Sheets

CONTACT FOR SOCKET

BACKGROUND OF THE INVENTION

1. Field of the Invention

The present invention relates to a contact for a socket, and particularly relates to a contact adapted for use with a socket and which is capable of resilient compression.

2. Background of the Invention

There are several kinds of connection methods between a socket and a peripheral device. A resilient compression connection with a contact is one kind of connection. A conventional contact illustrated in FIGS. 1 and 2 includes a base 1, a contact arm 2 extending from the base 1 upwardly, a carrier-tape arm 3 bent from the contact arm 2, and a solder portion 4 bent from a bottom of the base 1 at a right angle. The solder portion 4 is used for welding a welding material, such as a solder ball. A contact portion 6 slantwise extends upwardly from a top of the contact arm 2. In the assembly process, the conventional contact mates with an insulating housing 5, the base 1 is secured in a receiving slot 51 of the insulating housing 5, the contact portion 6 is exposed through the insulating housing 6, and the solder portion 4 aligns with a bottom of the insulating housing 5 to electrically connect to a circuit board (not shown) via the conventional contact. The peripheral device (not shown) can be placed above the contact portion 6 of the conventional socket, and further pressed downwardly to electrically connect the contact portion 6.

At least three shortcomings in this kind contact need to be overcome. First, to meet a predetermined height of the socket, the base shall be designed to be short, so as to result in a slackened retention between the base of the insulating housing. Second, the contact portion has a tapered and bent end to contact the peripheral device, thus a contact resistance between the peripheral device and the tapered end is too large to influence the electrical connection therebetween. Third, the conventional contact is processed by pluralities of bending steps that waste time and costs.

Hence, an improvement over the prior art is required to overcome the disadvantages thereof.

SUMMARY OF INVENTION

The primary object of the invention is therefore to specify a contact with a easy process and a secure connection that provides a low contact resistance for effective electrical connection.

According to the invention, the object is achieved by a contact adapted for use with a socket. The contact includes a base, an orientation arm, a resilient arm, and a solder portion. The resilient arm has a first portion extending from the base and a second portion bent upwardly from the first portion, and the second portion of the resilient arm is parallels to the base as an inverse type with a straight, turning angle. Therefore, the contact is processed easily and simply and is further capable of making a secure connection to a peripheral device. The contact resistance between the contact and the peripheral device is reduced thereby guaranteeing an effective electrical contact.

To provide a further understanding of the invention, the following detailed description illustrates embodiments and examples of the invention. Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE EMBODIMENTS

Figure 1:
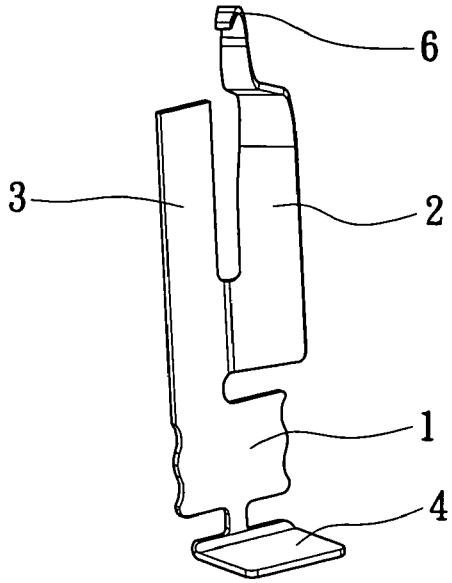
FIG. 1 PRIOR ART
FIG. 1 is a perspective view according to a conventional contact.
Figure 2:
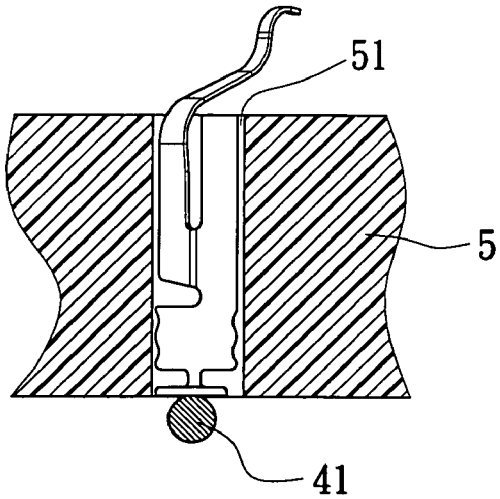
FIG. 2 PRIOR ART
FIG. 2 is a cross-sectional profile while the conventional contact assembles in an insulating housing.
Figure 3:
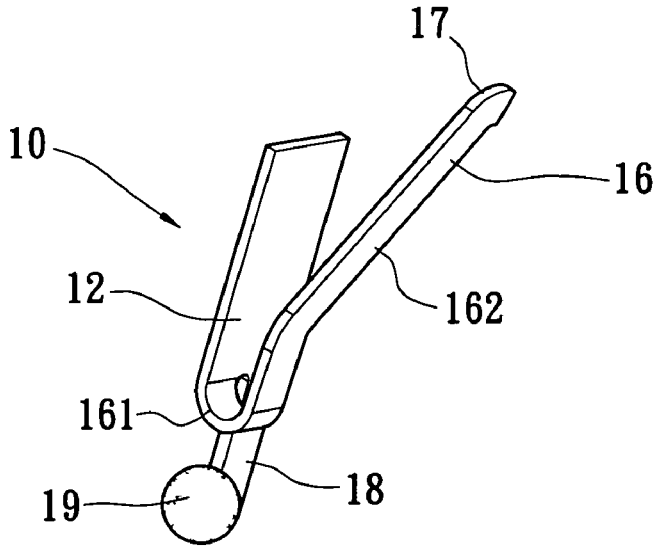
FIG. 3 is a perspective view of a contact with a solder ball according to a first embodiment of the present invention.
Figure 4:
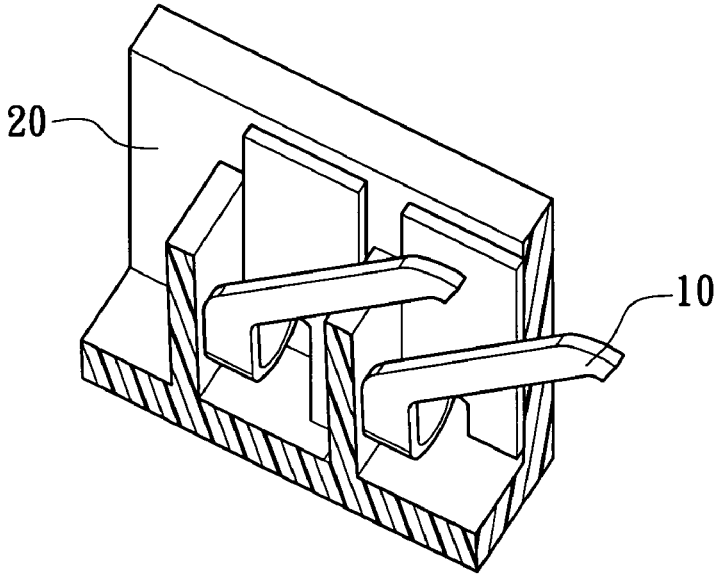
FIG. 4 is a perspective view while the contact assembles to an insulating housing according to the present invention.
Figure 5:
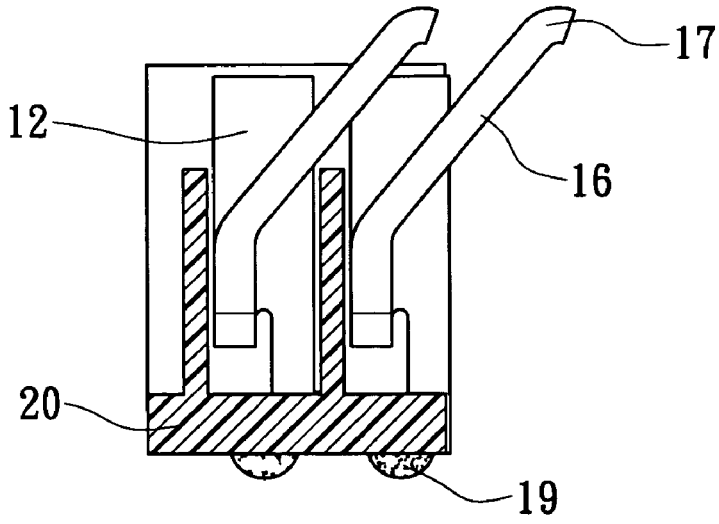
FIG. 5 is a cross-sectional profile while the contact assembles to an insulating housing according to the present invention.

FIGS. 3 to 5 illustrates a contact 10 according to a first embodiment of the present invention includes a base 12, a resilient arm 16 and a solder portion 18. The resilient arm 16 and the solder portion extend from a bottom of the base 12 simultaneously. The resilient arm 16 can be bent inversely, and includes a first portion 161 extending from the base 12 and a second portion 162 bent from the first portion 161 upwards, and the second portion 162 of the resilient arm 16 is parallels to the base 12 as an inverse type with a straight, turning angle. The second portion 162 further tilts towards a lateral side thereof at a predetermined angle. The resilient arm 16 has a contact portion 17 arranged on a free end of the second portion 162 in order to resiliently compress a peripheral device (not shown). The solder portion 18 can connect a solder material 19 in advance for electrical connecting a circuit board (not shown) later.

According to the first embodiment, the base 12 can be manufactured with a height as same as an insulating housing 20, so as to secure the contact 10 in the insulating housing 20. The peripheral device forces the resilient arm 16 of the contact 10 while the peripheral device assembles to the socket. The resilient arm 16 will bend laterally owing to the second portion 162 thereof tilts towards the lateral side thereof, and a recovery resistance of the resilient arm 16 will increase to abut against the peripheral device, thus a contact resistance between the peripheral device and contact 10 will reduce to guarantee an effective contact. Further more, the manufacturing steps of the contact 10 only include two steps: punching and bending, thus a simple process is provided.

Figure 6:
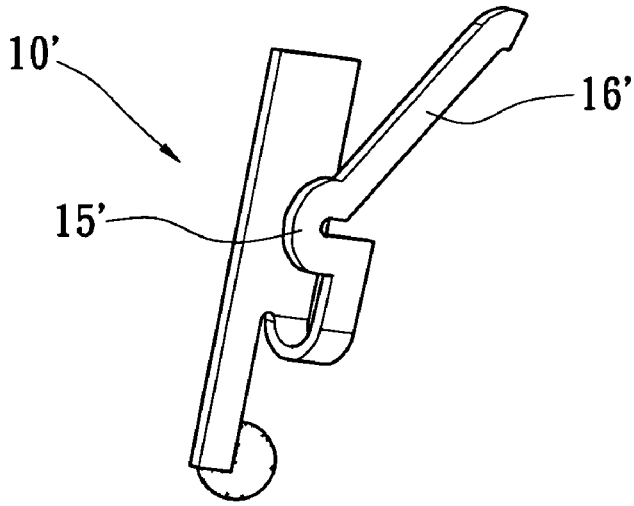
FIG. 6 is a perspective view of the contact according to a second embodiment of the present invention.

The configuration of the contact 10 can be various to meet same requirements. With respect to FIG. 6, a resilient arm

Figure 7:
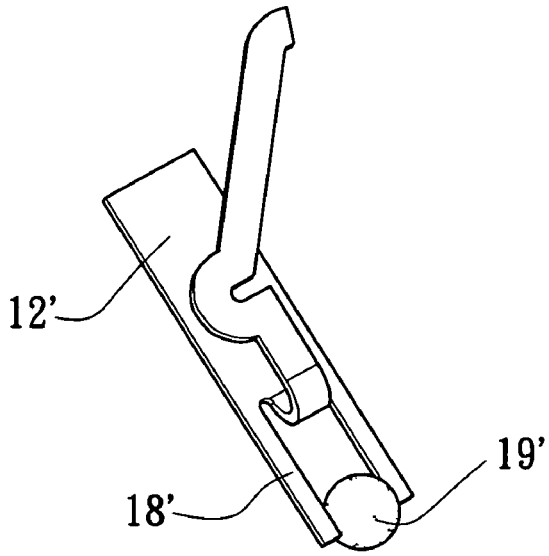
FIG. 7 is a perspective view of the contact according to a third embodiment of the present invention.
Figure 8:
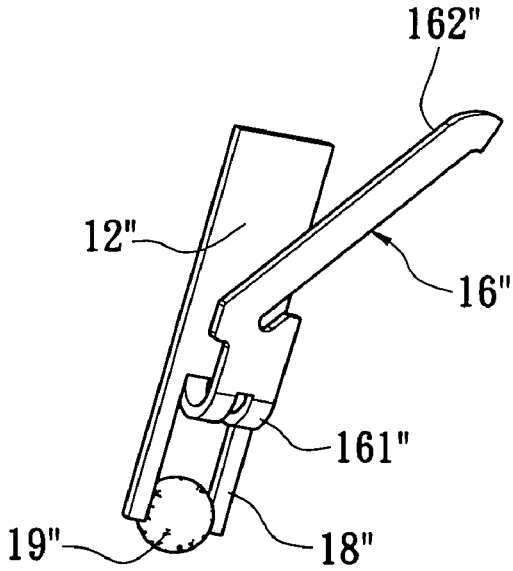
FIG. 8 is a perspective view of the contact according to a fourth embodiment of the present invention.
Figure 9:
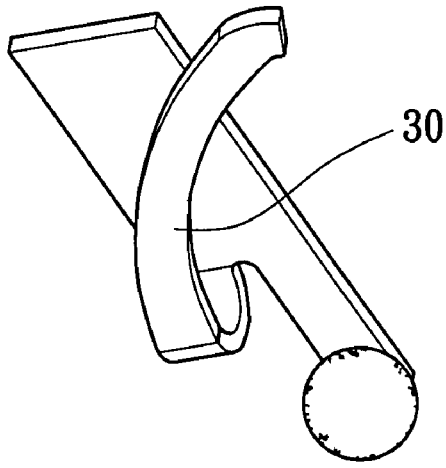
FIG. 9 is a perspective view of the contact according to a fifth embodiment of the present invention.
Figure 10:
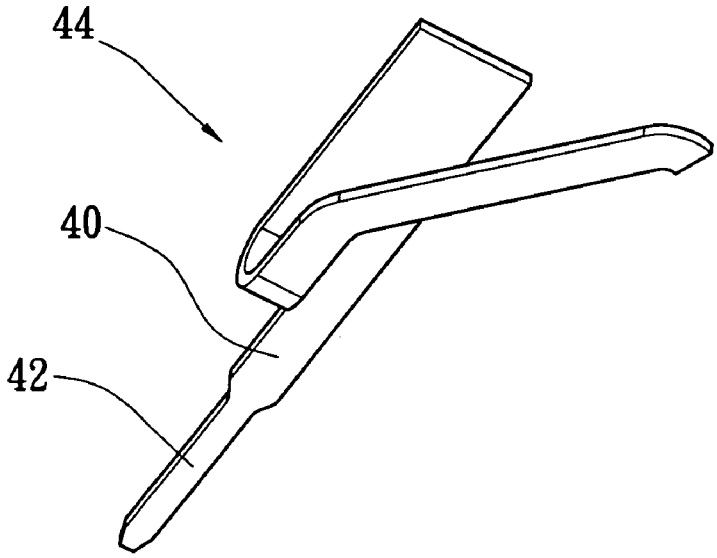
FIG. 10 is a perspective view of the contact according to a sixth embodiment of the present invention.

16' of a contact 10' has a curved portion 15', and a slanting portion extending from the curved portion 15' and tilting laterally, so as to increase an elasticity of the resilient arm 16'. Two solder portions 18' extend from two lateral sides of a bottom of a base 12' to clip a solder material 19' or 19" (in FIGS. 7, 8). Referring to FIG. 8, two first portions 161" of the resilient arm 16" parallel to each other and extend from a base 12", a second portion 162" can extend from a part of the first portion 161". FIG. 9 illustrates a second portion 30 of a resilient arm can be shaped of a bow or the like. FIG. 10 illustrates a solder portion 40 has a tongue 42 extending downwardly therefrom to penetrate through a circuit board for an electrical connection.

All of these contacts according to these embodiments mentioned above are processed easily and simply and further capable of secure connections respectively. The contact resistance between each contact and the peripheral device is reduced thereby to guarantee an effective electrical contact.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A contact adapted for use with a socket having a housing with a bottom wall and at least one receiving hole for receiving the contacts therethrough, said contact comprising:

a base extending upwardly from the bottom wall;

a resilient arm extending from a bottom of the base that is inversely bendable; and a solder portion extending downwardly from the base;

wherein the resilient arm includes a first portion extending from the base and a second portion extending upwardly bent from the first portion, the second portion of the resilient arm is parallel to the base as an inverse type with a straight, turning angle;

wherein the second portion has a contact portion arranged on a free end of the second portion that extends through the receiving hole and is at an angle where said angle is a predetermined angle with respect to the edge of the housing.

2. The contact as claimed in claim 1, wherein the second portion of the resilient arm tilts towards a lateral side thereof with a predetermined angle.

3. The contact as claimed in claim 1, wherein the solder portion extends from the bottom of the base.

4. The contact as claimed in claim 3, wherein the solder portion connects a solder material in advance.

5. The contacts as claimed in claim 3, wherein the solder portion has a tongue extending downwardly therefrom to penetrate through a circuit board for an electrical connection.

* * * * *